US010214986B2

(12) United States Patent
Wang et al.

(10) Patent No.: US 10,214,986 B2
(45) Date of Patent: Feb. 26, 2019

(54) VARIABLE RAM FOR A BLOWOUT PREVENTER AND AN ASSOCIATED METHOD THEREOF

(71) Applicant: General Electric Company, Schenectady, NY (US)

(72) Inventors: Jifeng Wang, Niskayuna, NY (US); Deepak Trivedi, Halfmoon, NY (US); Bodhayan Dev, Niskayuna, NY (US); Aaron John Mashue, Houston, TX (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 400 days.

(21) Appl. No.: 14/964,639

(22) Filed: Dec. 10, 2015

(65) Prior Publication Data

US 2017/0167219 A1 Jun. 15, 2017

(51) Int. Cl.
*E21B 33/06* (2006.01)

(52) U.S. Cl.
CPC ..... *E21B 33/062* (2013.01)

(58) Field of Classification Search
CPC ..... E21B 33/062
See application file for complete search history.

(56) References Cited

U.S. PATENT DOCUMENTS 4,550,895 A 11/1985 Shaffer
5,044,603 A 9/1991 Granger et al.
6,896,063 B2 5/2005 Chang et al.
6,955,357 B2 10/2005 Griffin et al.
7,188,678 B2 3/2007 Richard et al.
7,743,825 B2 6/2010 O'Malley et al.
7,857,066 B2 12/2010 DiFoggio et al.
(Continued)

FOREIGN PATENT DOCUMENTS

WO 2006102171 A2 9/2006
WO 2011133369 A1 10/2011
(Continued)

OTHER PUBLICATIONS

Hydril Pressure Control Annu-Flex™, GE Oil & Gas Drilling & Production, 2010, pp. 1-26.
(Continued)

*Primary Examiner* — Matthew R Buck
*Assistant Examiner* — Aaron L Lembo
(74) *Attorney, Agent, or Firm* — GE Global Patent Operation

(57) ABSTRACT

A variable ram for a blowout preventer is disclosed. The variable ram includes a ram block and a ram packer assembly disposed at least in part within the ram block. The ram packer assembly includes a plurality of inserts and a packer member. The plurality of inserts is configured to form an insert array, where the insert array includes a peripheral surface, and where the peripheral surface of the insert array is disposed facing an opening configured to receive a tubular member. The packer member is coupled to at least a portion of the plurality of inserts for providing a unitary structure to the ram packer assembly, where the packer member protrudes from the peripheral surface of the insert array into the opening to define a bore face of the variable ram, and where the packer member includes an elastomeric material.

12 Claims, 5 Drawing Sheets

(56) References Cited

U.S. PATENT DOCUMENTS

| | | | |
|---|---|---|---|
| 8,240,392 | B2 | 8/2012 | Barnard et al. |
| 8,397,836 | B2 | 3/2013 | Pool et al. |
| 8,439,082 | B2 | 5/2013 | O'Connell |
| 8,443,892 | B2 | 5/2013 | Richard et al. |
| 8,464,787 | B2 | 6/2013 | O'Malley |
| 8,616,276 | B2 | 12/2013 | Tips et al. |
| 8,646,537 | B2 | 2/2014 | Tips et al. |
| 8,684,100 | B2 | 4/2014 | Tingler et al. |
| 9,441,443 | B2 * | 9/2016 | Cantlon ..... E21B 33/062 |
| 2004/0021269 | A1 | 2/2004 | Gaudette et al. |
| 2004/0112597 | A1 | 6/2004 | Hamid et al. |
| 2006/0272826 | A1 | 12/2006 | Shuster et al. |
| 2008/0264647 | A1 | 10/2008 | Li |
| 2010/0163252 | A1 | 7/2010 | Regnault et al. |
| 2010/0294482 | A1 | 11/2010 | Araujo et al. |
| 2010/0310385 | A1 | 12/2010 | Denne |
| 2011/0259587 | A1 | 10/2011 | Joseph et al. |
| 2012/0000648 | A1 | 1/2012 | Mathew et al. |
| 2012/0018153 | A1 | 1/2012 | Yeh et al. |
| 2012/0055667 | A1 | 3/2012 | Ingram et al. |
| 2012/0139250 | A1 | 6/2012 | Inman |
| 2012/0175845 | A1 | 7/2012 | Duan et al. |
| 2012/0205105 | A1 | 8/2012 | Le et al. |
| 2012/0205106 | A1 | 8/2012 | Le et al. |
| 2012/0305253 | A1 | 12/2012 | O'Malley |
| 2013/0037267 | A1 | 2/2013 | Regnault et al. |
| 2013/0062049 | A1 | 3/2013 | Ren et al. |
| 2013/0062061 | A1 | 3/2013 | Taylor et al. |
| 2013/0087333 | A1 | 4/2013 | Seth et al. |
| 2013/0126170 | A1 | 5/2013 | Johnson et al. |
| 2013/0140043 | A1 | 6/2013 | Swanson et al. |
| 2013/0146286 | A1 | 6/2013 | Le et al. |
| 2013/0256991 | A1 | 10/2013 | Ramon et al. |
| 2014/0020910 | A1 | 1/2014 | Falkner et al. |
| 2014/0027129 | A1 | 1/2014 | Hannegan et al. |
| 2014/0054043 | A1 | 2/2014 | O'Malley |
| 2014/0183381 | A1 | 7/2014 | Carbaugh et al. |
| 2014/0183382 | A1 | 7/2014 | Carbaugh et al. |
| 2015/0040990 | A1 | 2/2015 | Mathiesen et al. |
| 2015/0115535 | A1 | 4/2015 | Trivedi et al. |

FOREIGN PATENT DOCUMENTS

| | | | |
|---|---|---|---|
| WO | 2011147021 | A1 | 12/2011 |
| WO | 2012003196 | A2 | 1/2012 |
| WO | 2012094488 | A3 | 10/2012 |
| WO | 2013139601 | A2 | 9/2013 |

OTHER PUBLICATIONS

International Search Report and Written Opinion issued in connection with corresponding Application No. PCT/US2016/065975 dated Mar. 17, 2017.

* cited by examiner

VARIABLE RAM FOR A BLOWOUT PREVENTER AND AN ASSOCIATED METHOD THEREOF

BACKGROUND

The present technique disclosed herein generally relates to a variable ram of a blowout preventer, and more specifically, to a packer member used in such variable ram.

Wellbores in hydrocarbon reservoirs are formed by rotating a drill bit coupled to a drill string/drill pipe. Typically, a wellbore so formed includes a wellhead casing through which the drill bit and the drill string are inserted into the hydrocarbon reservoirs for extraction of hydrocarbons (fluid) from the hydrocarbon reservoirs. A blowout preventer (BOP) is usually mounted on top of the wellhead casing for regulating pressure of the wellbore. Further, the BOP often includes a variable ram to shut (close) the wellhead casing should pressure in the wellbore become uncontrollable.

Such a variable ram typically includes ram packer assemblies having elastomeric packers and metallic inserts, which may be configured to close on the drill strings inserted within the wellhead casing, to prevent blowout of fluid from the wellbore. At high pressure and high temperature conditions, the elastomeric packers at a bore face of such variable ram undergo significantly large deformation, which damages the bore face thereby resulting in leakage of the fluid from the wellhead casing.

Thus, there is a need for an improved variable ram that is configured to minimize or prevent leakage of fluid from the wellhead casing, and also minimize damage caused to an elastomeric packer in the variable ram.

BRIEF DESCRIPTION

In accordance with one embodiment, a variable ram is disclosed. In accordance with aspects of the present technique, the variable ram includes a ram block and a ram packer assembly disposed at least in part within the ram block. The ram packer assembly includes a plurality of inserts and a packer member. The plurality of inserts is configured to form an insert array, where the insert array includes a peripheral surface. The peripheral surface of the insert array is disposed facing an opening configured to receive a tubular member. The packer member is coupled to at least a portion of the plurality of inserts for providing a unitary structure to the ram packer assembly. The packer member protrudes from the peripheral surface of the insert array into the opening to define a bore face of the variable ram. The packer member includes an elastomeric material.

In accordance with another embodiment, a blowout preventer is disclosed. In accordance with aspects of the present technique, the blowout preventer includes a housing having an opening configured to receive a tubular member and a pair of variable rams disposed facing each other within the housing. The pair of variable rams is configured to selectively move in and out of the housing. Each variable ram includes a ram block and a ram packer assembly disposed at least in part within the ram block. The ram packer assembly includes a plurality of inserts and a packer member. The plurality of inserts is configured to form an insert array, where the insert array includes a peripheral surface. The peripheral surface of the insert array is disposed facing the opening. The packer member is coupled to at least a portion of the plurality of inserts for providing a unitary structure to the ram packer assembly, where the packer member protrudes from the peripheral surface of the insert array into the opening to define a bore face of the variable ram. The packer member includes an elastomeric material.

In accordance with yet another embodiment, a method for controlling flow of a fluid from a wellbore through a blowout preventer is disclosed. In accordance with aspects of the present technique, the method includes receiving the fluid along a wellhead casing disposed around the wellbore. The wellhead casing includes a tubular member configured to extract the fluid from the wellbore. The blowout preventer is mounted on the wellhead casing, where the blowout preventer includes a housing and a pair of variable rams disposed facing each other within the housing. The housing has an opening configured to receive the tubular member. The method further includes moving the pair of variable rams out of the housing towards the opening, to close a bore face of each variable ram of the pair of variable rams, against the tubular member to restrain the flow of the fluid along the wellhead casing. Each variable ram includes a ram block and a ram packer assembly disposed at least in part within the ram block. The ram packer assembly includes a plurality of inserts configured to form an insert array, where the insert array includes a peripheral surface, and where the peripheral surface of the insert array is disposed facing the opening. The ram packer assembly further includes a packer member coupled to at least a portion of the plurality of inserts for providing a unitary structure to the ram packer assembly. The packer member protrudes from the peripheral surface of the insert array into the opening to define the bore face of the variable ram and where the packer member includes an elastomeric material.

DRAWINGS

These and other features and aspects of embodiments of the present technique will become better understood when the following detailed description is read with reference to the accompanying drawings in which like characters represent like parts throughout the drawings, wherein.

DETAILED DESCRIPTION

Embodiments discussed herein disclose a blowout preventer and a pair of variable rams disposed within the blowout preventer. In some embodiments, the blowout preventer includes a housing having an opening configured to receive a tubular member, such as a drill pipe. The opening may be a vertical through-hole disposed along an axial direction of the blowout preventer. The blowout preventer further includes a pair of variable rams disposed facing each other within the housing and configured to selectively move in and out of the housing relative to the opening. The blowout preventer is mounted on a wellhead casing having the drill pipe configured to extract hydrocarbons (fluid) from a wellbore, where the wellhead casing is disposed around the wellbore.

In one embodiment, each variable ram of the pair of variable rams includes a ram block and a ram packer assembly disposed at least in part within the ram block. The ram packer assembly includes a plurality of inserts and a packer member. The plurality of inserts is configured to form an insert array, where the insert array includes a peripheral surface disposed facing the opening. In some embodiments, the packer member is coupled to at least a portion of the plurality of inserts for providing a unitary structure to the ram packer assembly. Further, in these embodiments, the packer member protrudes from the peripheral surface of the insert array into the opening to define a bore face of the variable ram. In certain embodiments, the packer member includes an elastomeric material.

During operation, the packer member and the plurality of inserts are configured to close the bore face of each variable ram of the pair of variable rams against the drill pipe to restrain (i.e. seal) a flow of the fluid along the wellhead casing. In one or more embodiments, the ram packer assembly is configured to provide a uniform and high contact pressure and a substantially large contact area between the packer member and the drill pipe, thereby preventing leakage of the fluid. The ram packer assembly is further configured to decrease space between the packer member and the drill pipe, thus reducing shear and tensile strains applied on the bore face by the drill pipe.

Figure 1:
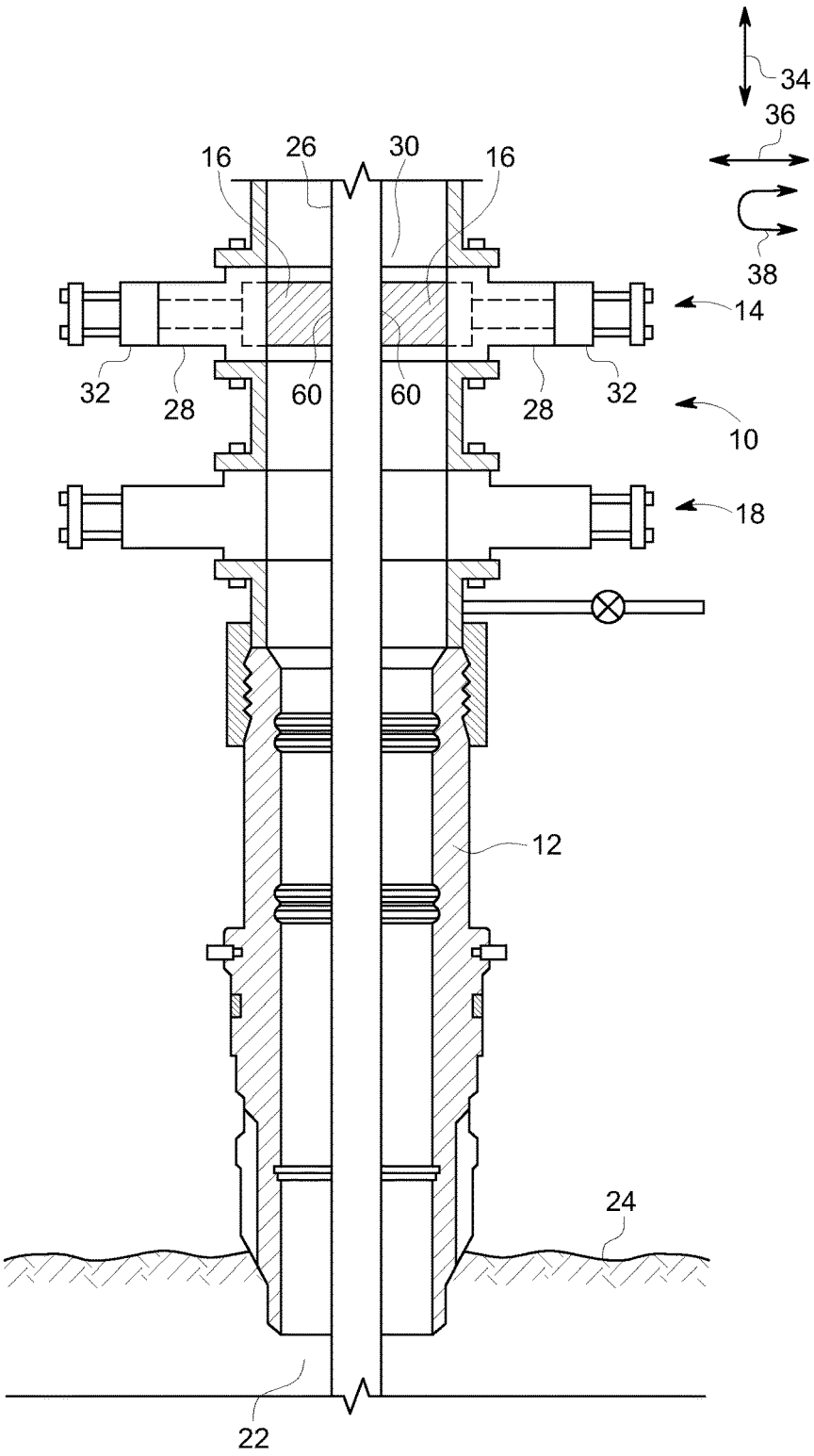
FIG. 1 is a cross-sectional view of a blowout preventer stack disposed on a wellhead casing, in accordance with aspects of the present technique.

FIG. 1 illustrates a cross-sectional view of a blowout preventer stack 10 in accordance with one embodiment of the present technique. The blowout preventer stack 10 includes a first blowout preventer 14 (also referred to as BOP) including a pair of variable rams 16 and a second blowout preventer 18 including a pair of blind shear rams (not shown in FIG. 1). The blowout preventer stack 10 is mounted on a wellhead casing 12. The wellhead casing 12 is disposed around a wellbore 22 formed through a surface 24 by a tubular member, such as, a drill pipe 26. In one example, a drill bit (not shown in figures) is coupled to a lower end of the drill pipe 26 which extends through the wellhead casing 12 and the wellbore 22 for extracting hydrocarbons from reservoir.

The BOP 14 is mounted on an upper end (not labeled in FIG. 1) of the wellhead casing 12. The BOP 14 includes a housing 28, the pair of variable rams 16, and a pair of biasing devices 32. The housing 28 has an opening 30 which is configured to receive the drill pipe 26. The pair of variable rams 16 is disposed facing each other within the housing 28. Each of the biasing devices 32 is coupled to a corresponding variable ram of the pair of variable rams 16. In certain embodiments, each of the biasing devices 32 may include a piston configured to reciprocate within a cylinder and a connecting rod coupled to such piston. Each biasing device 32 is configured to selectively move the pair of variable rams 16 laterally in and out of the housing 28 relative to the opening 30. Various other types of biasing device 32 are envisioned without limiting the scope of the present technique.

In certain embodiments, each variable ram 16 may include a ram block and a ram packer assembly disposed at least in part within the ram block. In such embodiments, the ram packer assembly may include a plurality of inserts (not shown in FIG. 1) and a packer member (not shown in FIG. 1). The variable ram 16 is discussed in greater detail below. In some embodiments, the second blowout preventer 18 is disposed below the BOP 14 and is mounted on the wellhead casing 12.

It should be noted that in a cylindrical coordinate system, reference numeral 34 represents an axial direction of the variable ram 16, reference numeral 36 represents a radial direction of the variable ram 16, and reference numeral 38 represents a circumferential direction of the variable ram 16.

During operation, the drill pipe is configured to excavate the wellbore 22 and extract hydrocarbons (fluid) from the reservoirs along the wellhead casing 12. In such embodiments, the extracted fluid from the reservoirs may be transported to a distant fluid storage facility through pipelines coupled to the wellhead casing 12. In some embodiments, during certain transient operating conditions, each of the biasing devices 32 is configured to move a corresponding variable ram 16 out of the housing 28 towards the opening 30. In such embodiments, a bore face 60 of each variable ram 16 seals the drill pipe 26 so as to restrain a flow of the fluid from the wellhead casing 12. In particular, the bore faces 60 of the pair of variable rams 16 are closed against the drill pipe 26 to restrain flow of the fluid along the wellhead casing 12. In some other embodiments, during certain transient operating conditions, the second blowout preventer 18 may be configured to cut through the drill pipe 26 as the pair of blind shear rams closes off the wellhead casing 12 to seal the wellbore 22 from an external environment. In one or more embodiments, the transient operation conditions may include extreme high pressure in the wellbore 22 and/or uncontrolled flow of the fluid along the wellhead casing 12.

In one or more embodiments, the pair of variable rams 16 is configured to provide a uniform and high contact pressure and a large contact area between a packer member and the drill pipe 26, thereby preventing leakage of the fluid. Further, the pair of variable rams 16 is configured to decrease spacing between the packer member and the drill pipe 26, thus reducing shear and tensile strains applied on the bore face 60 by the drill pipe 26.

It should be noted herein that the term "uniform contact pressure" refers to a substantially equal contact stress applied across the bore face, such as the bore face 60, and a circumference of the drill pipe, such as the drill pipe 26. Further, the term "high contact pressure" refers to a compressive load applied on the bore face and the drill pipe. Moreover, the term "large contact area" refers to a substantially greater surface area of the drill pipe that is in contact with the bore face as compared to contact area between the drill pipe and the bore face in conventional systems. Additionally, the term "decreased spacing" refers to a substantially less radial gap between the drill pipe and the bore face as compared to conventional systems.

Figure 2:
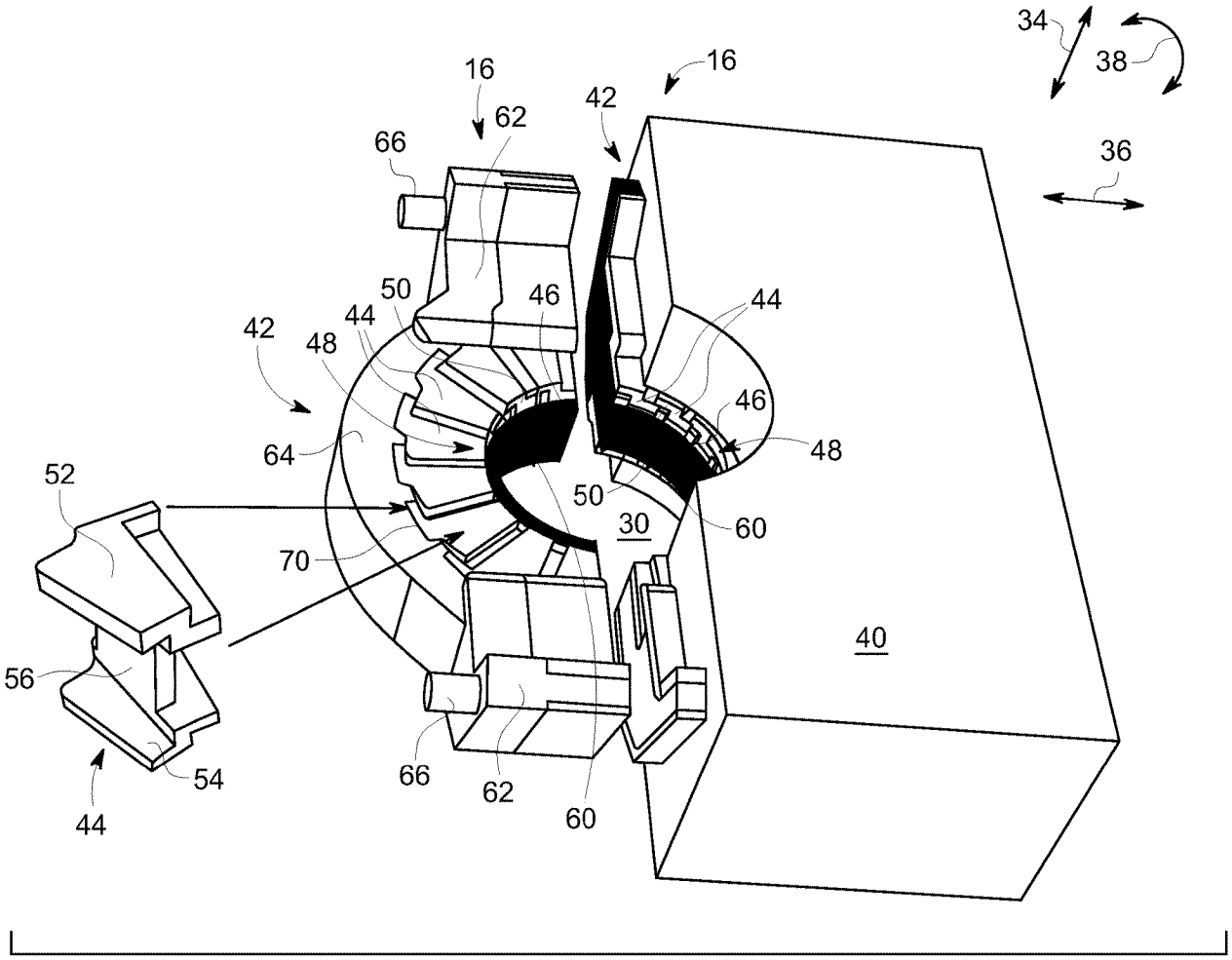
FIG. 2 is a perspective view of a pair of variable rams, in accordance with aspects of the present technique.

FIG. 2 illustrates a perspective view of a pair of variable rams 16 of FIG. 1 in accordance with one embodiment of the present technique. Each variable ram 16 includes a ram block 40 and a ram packer assembly 42. Although, in the illustrated embodiment, only one ram block 40 and a portion of one ram packer assembly 42 are shown to simplify the illustration of the pair of variable rams 16, however, the illustrated embodiment should not be construed as a limitation of the present technique. In one embodiment, each of the biasing devices 32 (as shown in FIG. 1) is coupled to a corresponding ram block 40 for selectively moving the pair of variable rams 16 in and out of the housing 28 (as shown in FIG. 1).

The ram packer assembly 42 is disposed at least in part within the ram block 40. In one embodiment, the ram packer assembly 42 includes a plurality of inserts 44 and a packer member 46. In the illustrated embodiment, each insert 44 of the plurality of inserts 44 includes a top plate 52, a bottom plate 54, and a central web 56 interconnecting the top plate 52 with the bottom plate 54. In certain embodiments, the plurality of inserts 44 is made of a metal. The plurality of inserts 44 is disposed adjacent to each other to form an insert array 48. In one embodiment, the insert array 48 includes a peripheral surface 50 which is disposed facing an opening 30 configured to receive a drill pipe 26 (as shown in FIG. 1).

In one embodiment, the packer member 46 is coupled to at least a portion of the plurality of inserts 44 for providing a unitary or integral structure to the ram packer assembly 42. In certain embodiments, the packer member 46 protrudes from the peripheral surface 50 of the insert array 48 into the opening 30 to define a bore face 60 of each variable ram 16. Specifically, the packer member 46 protrudes inwardly towards the opening 30 along a radial direction 36 of the variable ram 16. Further, the packer member 46 extends along a circumferential direction 38 of the variable ram 16. In some embodiments, the packer member 46 is made of an elastomeric material. Non-limiting examples of the elastomeric material may include rubber, neoprene, nitrile rubber, hydrogenated nitrile rubber, carboxylated nitrile rubber, natural rubber, butyl rubber, ethylene-propylene rubber, epiclorohydrin, chlorosulfunated polyethylene, fluororelastomers, or combinations thereof. The packer member 46 is discussed in greater detail below.

In certain embodiments, the packer member 46 may include BOP sealers having self-healing agents (not shown in FIG. 2) to improve longevity and operating range of the packer member 46 operating under high pressure (HP) and/or high temperature (HT) condition and repeated cycling. In such embodiments, the elastomeric material (herein also referred to as "elastomeric matrix") of the packer member 46 may be modified in one or more regions which may be susceptible to cracks under load, thereby allowing for in-situ healing of the cracks and prevention of degradation of the elastomeric matrix of the packer member 46 to the point of failure. Further, the BOP sealers may be designed in such a way that a self-healing process is triggered only when the cracks are propagated, and not during the molding and/or normal operation of the packer member 46. Also, contemplated herein are methods for improving the reliability of the packer member 46, which involves directing the elastomeric matrix to one or more specific areas in the packer member 46 which are susceptible to stress and cracking. Such specific areas may be identified using finite element analysis (FEM).

The BOP sealers having such self-healing agents contemplated herein may include microcapsules filled with, for example, thermosetting polymers, or alternatively, liquid additives which may aid in healing of cracks. Non-limiting examples of BOP sealers material including liquid additives may include polyethyleneimines. Non-limiting examples of the self-healing agents may include nitrocellulose cements, cyanoacrylate adhesives, epoxy based adhesives, aliphatic polyurethanes, isocyanate terminated aliphatic urethane prepolymers, dicyclopentadiene (DCPD), and the like, or combinations thereof.

During normal operating conditions, the packer member 46 may be subjected to a temperature range of about 0 deg. C. to about 180 deg. C. and pressure range from about 15 ksi to about 20 ksi. Under such conditions, the microcapsules may not break open by themselves and the liquid additive may not trigger healing of the elastomer. However, during high temperatures (HT) and high pressure (HP) operating conditions and/or cyclic loading conditions, cracks may be formed in the packer member 46, such as micro-cracks due to slippage between polymer chains of the elastomeric matrix. Under such conditions, the microcapsules may break open and initiate healing of the elastomer matrix, alternatively or in addition, the liquid additive may initiate healing of the elastomer matrix.

In one embodiment, the ram packer assembly 42 further includes a pair of wing seals 62, a packer side seal 64, and a pair of pins 66. The packer side seal 64 is coupled to another peripheral surface 70 of the insert array 48, disposed opposite to the peripheral surface 50. Each wing seal of the pair of wing seals 62 is coupled to a corresponding peripheral side of the ram packer assembly 42. Each pin of the pair of pins 66 is coupled to a corresponding wing seal of the pair of wings seals 62. In such embodiments, the ram packer assembly 42 is disposed at least in part in the ram block 40 and coupled to the ram block 40 via the pair of pins 66 and a corresponding pair of slots (not shown in FIG. 2) formed in the ram block 40.

Figure 3:
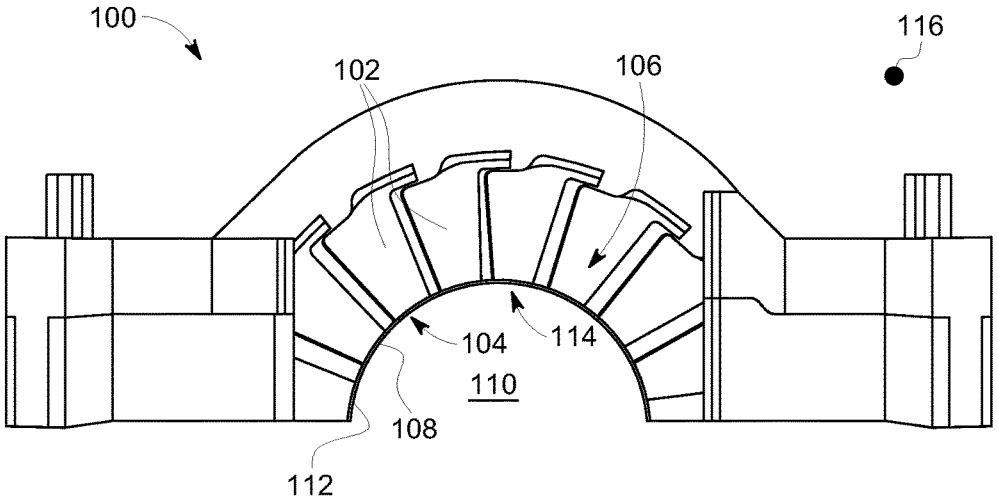
FIG. 3 PRIOR ART
FIG. 3 is a schematic diagram of a conventional ram packer assembly.

FIG. 3 illustrates a schematic diagram of a conventional ram packer assembly 100. In the illustrated embodiment, the conventional ram packer assembly 100 includes a plurality of inserts 102 and a packer member 104. The plurality of inserts 102 is configured to form an insert array 106 having a peripheral surface 108 disposed facing an opening 110. Further, a peripheral surface 112 of the packer member 104 is aligned with the peripheral surface 108 of the insert array 106 to define a bore face 114 of a variable ram. Specifically, the peripheral surface 112 of the packer member 104 is aligned with the peripheral surface 108 of the insert array 106 along an axial direction 116 of the variable ram. In such embodiments, during operation of the variable ram, the packer member 104 at the bore face 114 undergoes a significantly large deformation, which results in undesirable damage of the bore face 114, thereby resulting in the leakage of a fluid from a wellhead casing.

Figure 4:
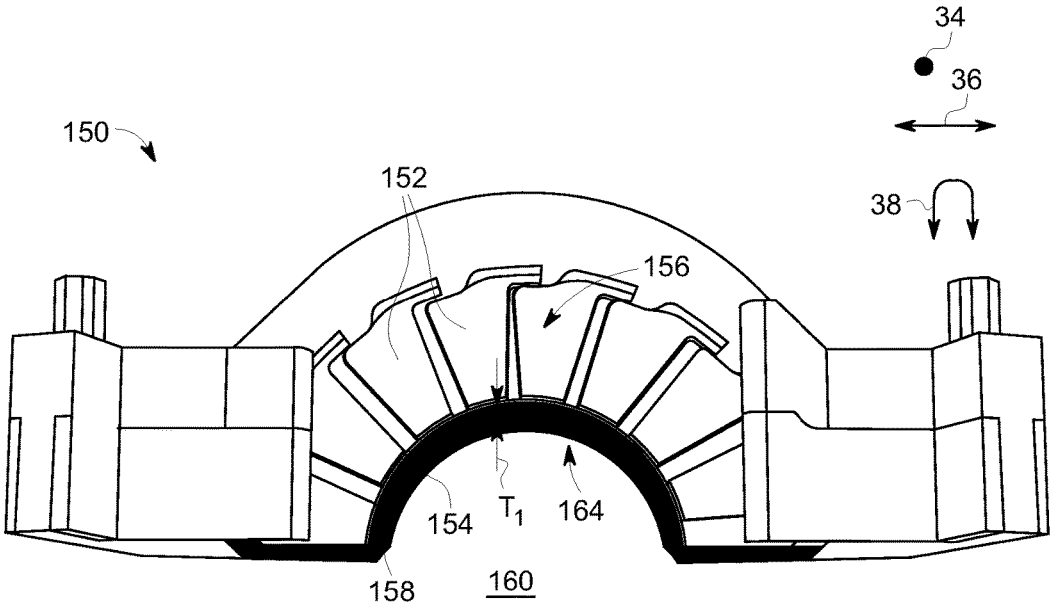
FIG. 4 is a schematic diagram of a ram packer assembly having a packer with uniform thickness, in accordance with aspects of the present technique.

FIG. 4 illustrates a schematic diagram of a ram packer assembly 150 in accordance with one embodiment of the present technique. The ram packer assembly 150 includes a plurality of inserts 152 and a packer member 154. The plurality of inserts 152 is configured to form an insert array 156 having a peripheral surface 158 disposed facing an opening 160. The packer member 154 is coupled to at least a portion of the plurality of inserts 152 for providing a unitary structure to the ram packer assembly 150. The packer member 154 protrudes from the peripheral surface 158 of the insert array 156 into the opening 160 to define a bore face 164 of a variable ram. In one embodiment, the packer member 154 protrudes inwardly towards the opening 160 along a radial direction 36 of the variable ram. Further, the packer member 154 extends along a circumferential direction 38 of the variable ram. In one embodiment, the packer member 154 has a uniform thickness "$T_1$" with respect to the peripheral surface 158 to define the bore face 164. In certain embodiments, the thickness "$T_1$" is in a range from about 150 mils to about 250 mils.

During operation, the ram packer assembly 150 is configured to provide a uniform and high contact pressure and a substantially large contact area between the packer member 154 and a drill pipe 26 (as shown in FIG. 1), thereby preventing leakage of a fluid. In one embodiment, the ram packer assembly 150 is designed to increase contact pressure on the bore face 164 and the drill pipe 26 in a range from about 15 percent to about 20 percent of a contact pressure on a bore face and a drill pipe of a conventional ram packer assembly, such as the ram packer assembly 100 of FIG. 3. Further, the ram packer assembly 150 is designed to increase contact area between the packer member 154 and the drill pipe 26 in a range from about 15 percent to about 25 percent of a contact area between a packer member and a drill pipe of a conventional ram packer assembly, such as the ram packer assembly 100 of FIG. 3.

Advantageously, the ram packer assembly 150 is configured to decrease spacing between the packer member 154 and the drill pipe 26, thereby reducing shear and tensile strains that are applied on the bore face 164 by the drill pipe 26. In one embodiment, the spacing between the packer member 154 and the drill pipe 26 is decreased in a range from about 150 mils to about 250 mils. In one embodiment, the ram packer assembly 150 facilitates reduction of the shear and tensile strains experienced by the bore face 164 from about 14 percent to about 18 percent of the shear and tensile strains experienced by a bore face in a conventional ram packer assembly, such as the ram packer assembly 100 of FIG. 3. Additionally, the ram packer assembly 150 facilitates increase in the contact pressure on the bore face 164 from about 30 percent to about 40 percent compared to the conventional ram packer assembly 100 of FIG. 3.

During high pressure (HP) and/or high temperature (HT) conditions, the conventional packer member 104 (see FIG. 3) at the bore face 114, (see FIG. 3) may deform and wear, thereby resulting in failure of the packer member 104. In the present technique, the packer member 154 at the bore face 164 may substantially reduce a space required for contacting the drill pipe 26. Thus, the bore face 164 may undergo less deformation and wear. Further, during cyclic loading condition, an axial and a circumferential movement of the drill pipe 26 may result in wear and tear of the conventional packer member 104 at the bore face 114. This wear and tear of the conventional packer member results in depletion of the conventional packer member, thereby resulting in leakage of the fluid. Advantageously, in the present technique, the packer member 154 disposed at the bore face 164 facilitates a uniform and high contact pressure to provide leak proof seal between the bore face 164 and the drill pipe 26, thus resulting in less wear and removal of the packer member 154 at the bore face 164.

Figure 5:
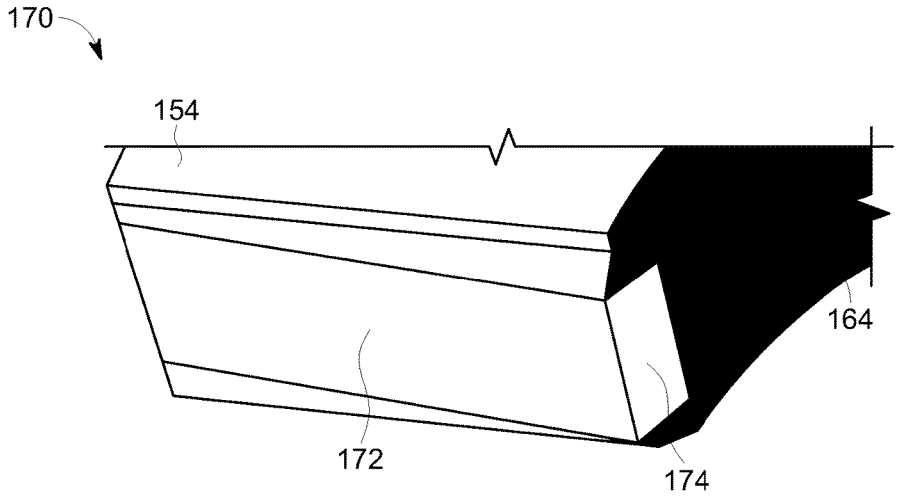
FIG. 5 is a perspective view of a portion of a packer member employed in a ram packer assembly, in accordance with aspects of the present technique.

FIG. 5 illustrates a perspective view of a portion 170 of the packer member 154 shown in FIG. 4 in accordance with one embodiment of the present technique. The packer member 154 includes a first base portion 172 and a second base portion (not shown in FIG. 5). The first base portion 172 and the second base portion have a wedge portion 174 that is coupled to the packer member 154 at the bore face 164. In one or more embodiments, the wedge portion 174 is configured to provide smooth connection between the bore face 164 and the first base portion 172 and the second base portion. In addition, the wedge portion 174 is configured to facilitate smooth contact of the bore face 164 with the drill pipe 26 with minimal or no damage to the bore face 164.

Figure 6:
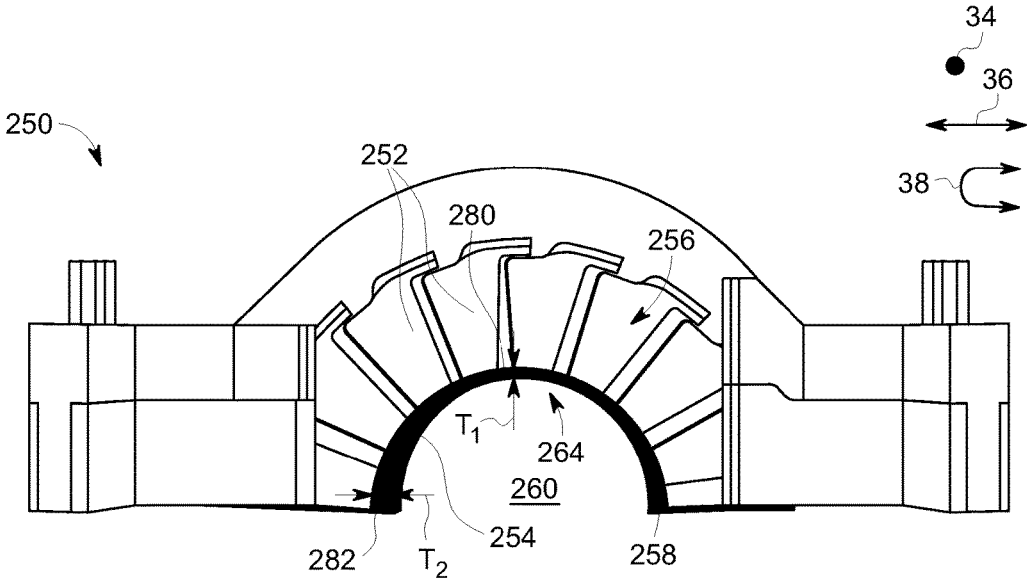
FIG. 6 is a schematic diagram of a ram packer assembly having a packer member with non-uniform thickness, in accordance with aspects of the present technique.

FIG. 6 illustrates a schematic diagram of a ram packer assembly 250 in accordance with another embodiment of the present technique. The ram packer assembly 250 includes a plurality of inserts 252 and a packer member 254. The plurality of inserts 252 is configured to form an insert array 256 having a peripheral surface 258 disposed facing an opening 260. The packer member 254 is coupled to at least a portion of the plurality of inserts 252 for providing a unitary structure to the ram packer assembly 250. The packer member 254 protrudes from the peripheral surface 258 of the insert array 256 into the opening 260 to define a bore face 264 of a variable ram. In one embodiment, the packer member 254 has a non-uniform thickness with respect to the peripheral surface 258 to define the bore face 264. In a non-limiting example, the non-uniform thickness of the packer member 254 is configured to form a semi-circular shape along the peripheral surface 258 of the insert array 256. In the illustrated embodiments, the packer member 254 has a first thickness "$T_1$" at a middle portion 280 of the ram packer assembly 250 and a second thickness "$T_2$" at portions 282 that are adjacent to the middle portion 280 of the ram packer assembly 250 to define the semi-circular shape of the bore face 264. However, it may be noted that packer member 254 having more than two thickness values or gradually changing thickness values are also envisioned within the scope of the present technique. In one embodiment, the first thickness "$T_1$" is in a range from about 25 mils to about 75 mils, and the second thickness "$T_2$" is in a range from about 150 mils to about 250 mils.

As with the packer member 154 of FIG. 4, the packer member 254 at the bore face 264 is configured to prevent leakage by increasing contact pressure between the bore face 264 and a drill pipe 26 (as shown in FIG. 1) and reduce damage of the bore face 264 by minimizing shear strain magnitude. In the present technique, the semi-circular shape of the bore face 264 may ensure a uniform and high contact pressure between the bore face 264 and the drill pipe 26, and a reduction of deformation magnitude in the bore face 264. Thus, reducing leakage of a fluid and wear of the packer member 254 at the bore face 264.

In one embodiment, the ram packer assembly 250 is designed to increase contact pressure on the bore face 264 and the drill pipe 26 in a range from about 10 percent to about 15 percent of a contact pressure on a bore face and a drill pipe of a conventional ram packer assembly, such as the ram packer assembly 100 of FIG. 3. Further, the ram packer assembly 250 facilitates enhanced contact area between the packer member 254 and the drill pipe 26 in a range from about 15 percent to about 25 percent of a contact area between a packer member and a drill pipe of a conventional ram packer assembly, such as the ram packer assembly 100 of FIG. 3. Further, the spacing between the packer member 254 and the drill pipe 26 is decreased from about 25 mils to about 250 mils.

Figure 7:
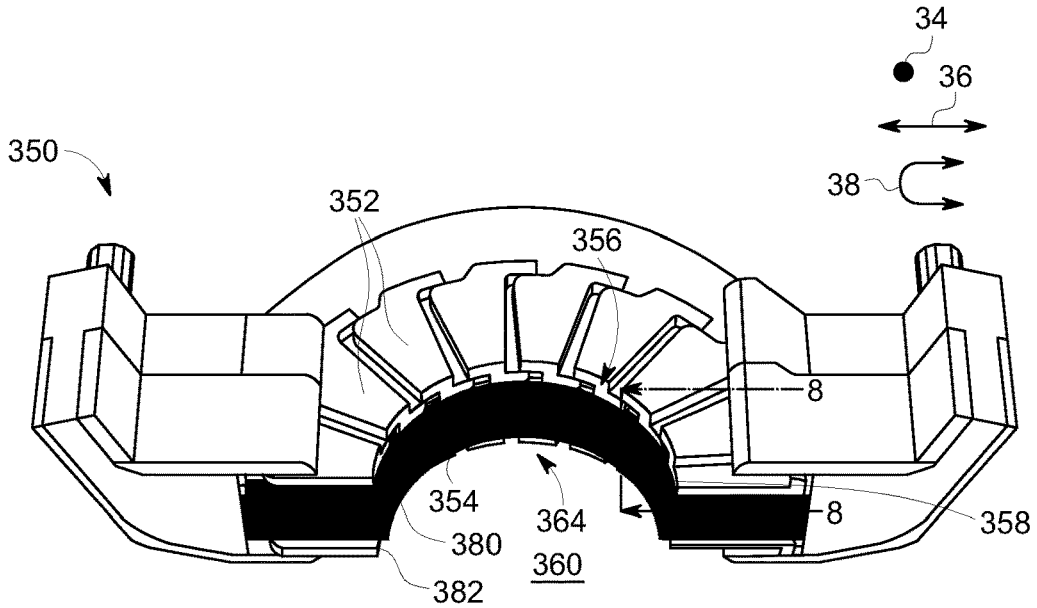
FIG. 7 is a perspective view of a ram packer assembly, in accordance with aspects of the present technique.
Figure 8:
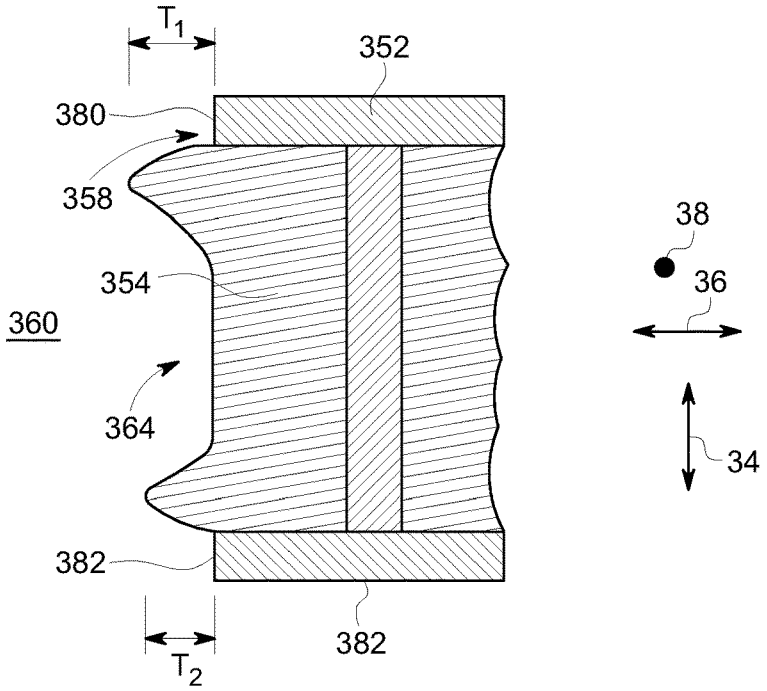
FIG. 8 is schematic cross-sectional view of the ram packer assembly taken along line 8-8 in FIG. 7, in accordance with aspects of the present technique.

Referring now to FIGS. 7-8, FIG. 7 is a perspective view of a ram packer assembly 350 in accordance with yet another embodiment of the present technique and FIG. 8 is a cross-sectional view of the ram packer assembly 350 taken along line 8-8 in FIG. 7. The ram packer assembly 350 includes a plurality of inserts 352 and a packer member 354. The plurality of inserts 352 is configured to form an insert array 356 having a peripheral surface 358 disposed facing an opening 360. The packer member 354 is coupled to at least a portion of the plurality of inserts 352 for providing a unitary structure to the ram packer assembly 350. The peripheral surface 358 of the insert array 356 includes a top portion 380 and a bottom portion 382.

In the illustrated embodiment, the packer member 354 has a first thickness "$T_1$" at the top portion 380 of the peripheral surface 358 and a second thickness "$T_2$" at the bottom portion 382 of the peripheral surface 358. In one embodiment, the first thickness "$T_1$" and the second thickness "$T_2$" extends inwardly in a radial direction 36 of a variable ram. In the illustrated embodiment, the bore face 364 when viewed from a side may have a concave shape. Further, the thicknesses "$T_1$" and "$T_2$" are substantially uniform. In such embodiments, the thicknesses "$T_1$" and "$T_2$" is in a range from about 150 mils to about 250 mils. In some other embodiments, the thicknesses "$T_1$" and "$T_2$" are substantially different depending on the application and design criteria. In such embodiments, the thickness "$T_1$" is in a range from about 175 mils to 225 mils and the thickness "$T_2$" is in a range from about 200 mils to about 250 mils. It should be noted that the packer member 354 with greater thickness "$T_2$" may provide higher pressure bearing capability and may further ensure uniform deformation of the packer member 354 at the bottom portion 382, which faces a flow of the fluid along a wellhead casing.

Advantageously, the packer member 354 at the bore face 364 is configured to prevent leakage by increasing the contact pressure between the bore face 364 and a drill pipe 26 (as shown in FIG. 1) and reducing undesirable deformation and/or damage to the bore face 364 by minimizing magnitude of the shear and tensile strains. In one embodiment, the ram packer assembly 350 is designed to increase contact pressure on the bore face 364 and the drill pipe 26 in a range from about 8 percent to about 10 percent of a contact pressure on a bore face and a drill pipe of a conventional ram packer assembly, such as the ram packer assembly 100 of FIG. 3. Further, the ram packer assembly 350 facilitates increase in the contact area between the packer member 354 and the drill pipe 26 in a range from about 15 percent to about 25 percent of a contact area between a packer member and a drill pipe of a conventional ram packer assembly, such as the ram packer assembly 100 of FIG. 3. Further, the spacing between the packer member 354 and the drill pipe 26 may decrease from about 150 mils to about 250 mils.

The ram packer assemblies 150, 250, 350 discussed in the embodiments of FIGS. 4, 6, and 7 are configured to provide a uniform and high contact pressure between the packer members 154, 254, 354 and the drill pipe 26, thereby preventing leakage of a fluid from the wellhead casing 12. Further, the ram packer assemblies 150, 250, 350 are configured to decrease spacing between the packer members 154, 254, 354 and the drill pipe 26, thus reducing shear and tensile strains experienced by the bore faces 164, 264, 364, when the bore faces 164, 264, 364 are in contact with the drill pipe 26 during transient operating conditions, as discussed in the embodiments of FIG. 1.

In accordance with one or more embodiments discussed herein, a packer member having a protruded portion into an opening, to define a bore face of a variable ram is configured to minimize or prevent leakage of a fluid by increasing contact pressure between the bore face and a drill pipe. Further, the packer member may reduce damage to the bore face by minimizing shear and tensile strains magnitude. The packer member at the bore face may deflect to one or more regions on the drill pipe, where a low contact pressure and narrow contact area exist, to ensure a uniform contact pressure and large contact area between the packer member and the drill pipe. Thus, the packer member may improve performance and reliability of the variable ram. Further, the packer member may increase fatigue life of the variable ram.

While only certain features of embodiments have been illustrated and described herein, many modifications and changes will occur to those skilled in the art. It is, therefore, to be understood that the appended claims are intended to cover all such modifications and changes as falling within the spirit of the invention.

The invention claimed is:

1. A variable ram comprising:

a ram block; and a ram packer assembly disposed at least in part within the ram block, wherein the ram packer assembly comprises:

a plurality of inserts configured to form an insert array, wherein the insert array comprises a peripheral surface, and wherein the peripheral surface of the insert array is disposed facing an opening configured to receive a tubular member; and a packer member coupled to at least a portion of the plurality of inserts for providing a unitary structure to the ram packer assembly, wherein the packer member protrudes from the peripheral surface of the insert array into the opening to define a bore face of the variable ram, wherein the packer member comprises an elastomeric material, and wherein the packer member has a non-uniform thickness along a circumferential direction of the variable ram to define the bore face.

2. The variable ram of claim 1, wherein the packer member protrudes inwardly towards the opening along a radial direction of the variable ram.

3. The variable ram of claim 1, wherein the packer member comprises a first base portion and a second base portion, wherein the first base portion and the second base portion comprise a wedge portion configured to provide a smooth connection between a respective base portion and the bore face, and interface between the bore face and a tubular member.

4. The variable ram of claim 1, wherein the peripheral surface of the insert array comprises a top portion and a bottom portion, wherein the packer member has a first thickness along an axial direction of the variable ram at the top portion and a second thickness along the axial direction at the bottom portion, to define the bore face.

5. A blowout preventer comprising:

a housing having an opening configured to receive a tubular member; and a pair of variable rams disposed facing each other within the housing, wherein the pair of variable rams is configured to selectively move in and out of the housing, wherein each variable ram comprises:

a ram block; and a ram packer assembly disposed at least in part within the ram block, wherein the ram packer assembly comprises:

a plurality of inserts configured to form an insert array, wherein the insert array comprises a peripheral surface, and wherein the peripheral surface of the insert array is disposed facing the opening; and a packer member coupled to at least a portion of the plurality of inserts for providing a unitary structure to the ram packer assembly, wherein the packer member protrudes from the peripheral surface of the insert array into the opening to define a bore face of the variable ram, wherein the packer member comprises an elastomeric material, and wherein the packer member has a non-uniform thickness along a circumferential direction of each variable ram to define the bore face.

6. The blowout preventer of claim 5, further comprising a pair of biasing devices, wherein each biasing device of the pair of biasing devices is coupled to a corresponding variable ram of the pair of variable rams, for selectively moving the pair of variable rams.

7. The blowout preventer of claim 5, wherein the packer member protrudes inwardly towards the opening along a radial direction of each variable ram.

8. The blowout preventer of claim 5, wherein the packer member comprises a first base portion and a second base portion, wherein the first base portion and the second base portion comprise a wedge portion configured to provide a smooth connection between a respective base portion and the bore face, and interface between the bore face and the tubular member.

9. The blowout preventer of claim 5, wherein the peripheral surface of the insert array comprises a top portion and a bottom portion, wherein the packer member has a first thickness along an axial direction of each variable ram at the top portion and a second thickness along the axial direction at the bottom portion, to define the bore face of each variable ram.

10. A method for controlling flow of a fluid from a wellbore through a blowout preventer, the method comprising:

receiving the fluid along a wellhead casing comprising a tubular member configured to extract the fluid from the wellbore, wherein the wellhead casing is disposed around the wellbore, wherein the blowout preventer is mounted on the wellhead casing, wherein the blowout preventer comprises a housing and a pair of variable rams disposed facing each other within the housing, wherein the housing has an opening configured to receive the tubular member; and moving the pair of variable rams out of the housing towards the opening, to close a bore face of each variable ram of the pair of variable rams, against the tubular member to restrain the flow of the fluid along the wellhead casing, wherein each variable ram comprises a ram block and a ram packer assembly disposed at least in part within the ram block, wherein the ram packer assembly comprises: a plurality of inserts configured to form an insert array, wherein the insert array comprises a peripheral surface, and wherein the peripheral surface of the insert array is disposed facing the opening and a packer member coupled to at least a portion of the plurality of inserts for providing a unitary structure to the ram packer assembly, wherein the packer member protrudes from the peripheral surface of the insert array into the opening to define the bore face of each variable ram, wherein the packer member comprises an elastomeric material, and wherein the packer member has a non-uniform thickness along a circumferential direction of the variable ram to define the bore face.

11. The method of claim 10, wherein the packer member comprises a first base portion and a second base portion, wherein the first base portion and the second base portions comprise a wedge portion configured to provide a smooth connection between a respective base portion and the bore face, and interface between the bore face and the tubular member.

12. The method of claim 10, wherein the peripheral surface of the insert array comprises a top portion and a bottom portion, wherein the packer member has a first thickness along an axial direction of the variable ram at the top portion and a second thickness along the axial direction at the bottom portion, to define the bore face of each variable ram.

* * * * *